US007748644B2

(12) United States Patent
Ricco et al.

(10) Patent No.: US 7,748,644 B2
(45) Date of Patent: Jul. 6, 2010

(54) FUEL INJECTOR FOR AN INTERNAL-COMBUSTION ENGINE

(75) Inventors: Mario Ricco, Valenzano (IT); Sisto Luigi De Matthaeis, Valenzano (IT); Adriano Gorgoglione, Valenzano (IT); Alfonso Di Meo, Valenzano (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 1083 days.

(21) Appl. No.: 11/111,002

(22) Filed: Apr. 21, 2005

(65) Prior Publication Data

US 2006/0011736 A1 Jan. 19, 2006

(30) Foreign Application Priority Data

Jun. 30, 2004 (EP) ..... 04425477

(51) Int. Cl.
*F02M 47/02* (2006.01)
*F02M 59/00* (2006.01)
*B05B 1/30* (2006.01)

(52) U.S. Cl. ..... 239/92; 239/88; 239/91; 239/533.2; 239/585.1

(58) Field of Classification Search ..... 239/88–92, 239/96, 124, 533.2–533.8, 585.1
See application file for complete search history.

(56) References Cited

U.S. PATENT DOCUMENTS

| | | | | |
|---|---|---|---|---|
| 4,149,496 | A * | 4/1979 | Palma | 123/470 |
| 4,711,397 | A * | 12/1987 | Lahiff | 239/125 |
| 6,082,332 | A | 7/2000 | Hefler et al. | 123/446 |
| 6,837,221 | B2 * | 1/2005 | Crofts et al. | 123/467 |
| 6,845,926 | B2 * | 1/2005 | Lei | 239/533.2 |
| 7,267,533 | B1 * | 9/2007 | Tocci et al. | 417/552 |
| 7,335,300 | B1 * | 2/2008 | Stamey et al. | 210/234 |
| 7,422,006 | B2 * | 9/2008 | Noller et al. | 123/498 |
| 2003/0062492 | A1 | 4/2003 | Haeberer et al. | |

FOREIGN PATENT DOCUMENTS

| | | |
|---|---|---|
| DE | 199 53 888 A1 | 5/2001 |
| EP | 0 890 729 A2 | 1/1999 |
| EP | 0 916 841 A1 | 5/1999 |
| EP | 1 223 338 A2 | 7/2002 |

* cited by examiner

*Primary Examiner*—Dinh Q Nguyen
*Assistant Examiner*—Justin Jonaitis
(74) *Attorney, Agent, or Firm*—Seed IP Law Group PLLC

(57) ABSTRACT

A fuel injector for an internal-combustion engine houses, in a hollow injector body of its own, an injection-control valve, the valve body of which delimits, together with the injector body, an annular chamber designed to receive a fuel under pressure, and insulated in a fluid-tight way by a seal member carried by the valve body and made of plastic material.

14 Claims, 2 Drawing Sheets

FUEL INJECTOR FOR AN INTERNAL-COMBUSTION ENGINE

BACKGROUND OF THE INVENTION

1. Field of the Invention

The present invention relates to a fuel injector for an internal-combustion engine.

In particular, the present invention relates to an injector of the type comprising a hollow injector body, which has an axis of its own and delimits a seat for housing an injection-control valve. The valve in turn comprises a valve body of a tubular shape inserted and blocked inside the seat of the injector body coaxially to the cited axis by means of a ring-nut screwed into the seat on the injector body to force an external flange of the valve body against an internal shoulder of the injector body itself. The valve further comprises an open/close element pressed against a head surface of the valve body by an elastic thrust element, and an electric actuator set along the aforesaid axis to exert an action countering the one exerted by the elastic element and to enable the open/close element to set itself at a distance from the aforesaid head surface. Between the valve body and the injector body there is obtained an annular chamber, into which there is an outlet for pipe for supply of fuel under pressure to be injected. The chamber, which shares the aforesaid axis, is delimited in an axial direction by two shoulders facing one another, one of which is carried by the injector body and the other by the valve body. For the purpose of preventing leakage of fuel between the injector body and the valve body, against the shoulder of the injector body there is set a ring seal made of elastomeric material. On the shoulder of the valve body there acts, instead, in use, the pressure of the fuel contained in the annular chamber, generating an axial thrust directed towards the ring-nut.

2. Description of the Related Art

Albeit universally used, known injectors of the type described above are far from efficient and reliable and hence are not altogether satisfactory, above all when the regulation of the injection is carried out with particularly contained strokes or lifts of the open/close element.

The inefficiency can basically put down to the fact that, on account of the particular conformation of the annular seat that receives the fuel under pressure, the fuel itself generates on the valve body axial thrusts opposite to the elastic thrust exerted by the elastic body on the open/close element. Said thrusts, which are proportional to the pressure of introduction of the fuel, are unloaded on the injector body through the ring-nut and deform the valve body elastically. Consequently, during operation of the injector, the open/close element and the electric actuator are set in relative positions different from the ones envisaged in the design stage, and hence the effective lifts of the open/close element, i.e., in operating conditions, are different from the ones envisaged.

Furthermore, since the elastic deformations of the valve body are normally of the order of a few micron and strictly linked to the instantaneous value of the pressure of the fuel in the annular chamber, they do not represent a fixed offset with respect to the static situation in the absence of pressure, and hence can in no way be compensated for in the stage of setting of the injector.

BRIEF SUMMARY OF THE INVENTION

One purpose of the present invention is to provide a fuel injector, the characteristics of construction of which will provide a more efficient fuel injector in a simple and economically advantageous way.

According to the present invention, a fuel injector for an internal-combustion engine is provided, comprising: an injector body having a seat; an injection-control valve, comprising a valve body set in said seat for delimiting an annular chamber designed to receive a fuel under pressure; and first and second fluid-tight means set on opposite axial sides of said annular chamber for insulating the chamber in a fluid-tight way, said second fluid-tight means comprising a seal member set between said injector body and said valve body, said injector being characterized in that said seal member is carried by said valve body.

Preferably, in the injector defined above, said seal member is a body made of plastic material.

BRIEF DESCRIPTION OF THE SEVERAL VIEWS OF THE DRAWINGS

The invention will now be described with reference to the annexed plate of drawings, which illustrate a non-limiting example of embodiment thereof, and in which.

DETAILED DESCRIPTION OF THE INVENTION

Figure 1:
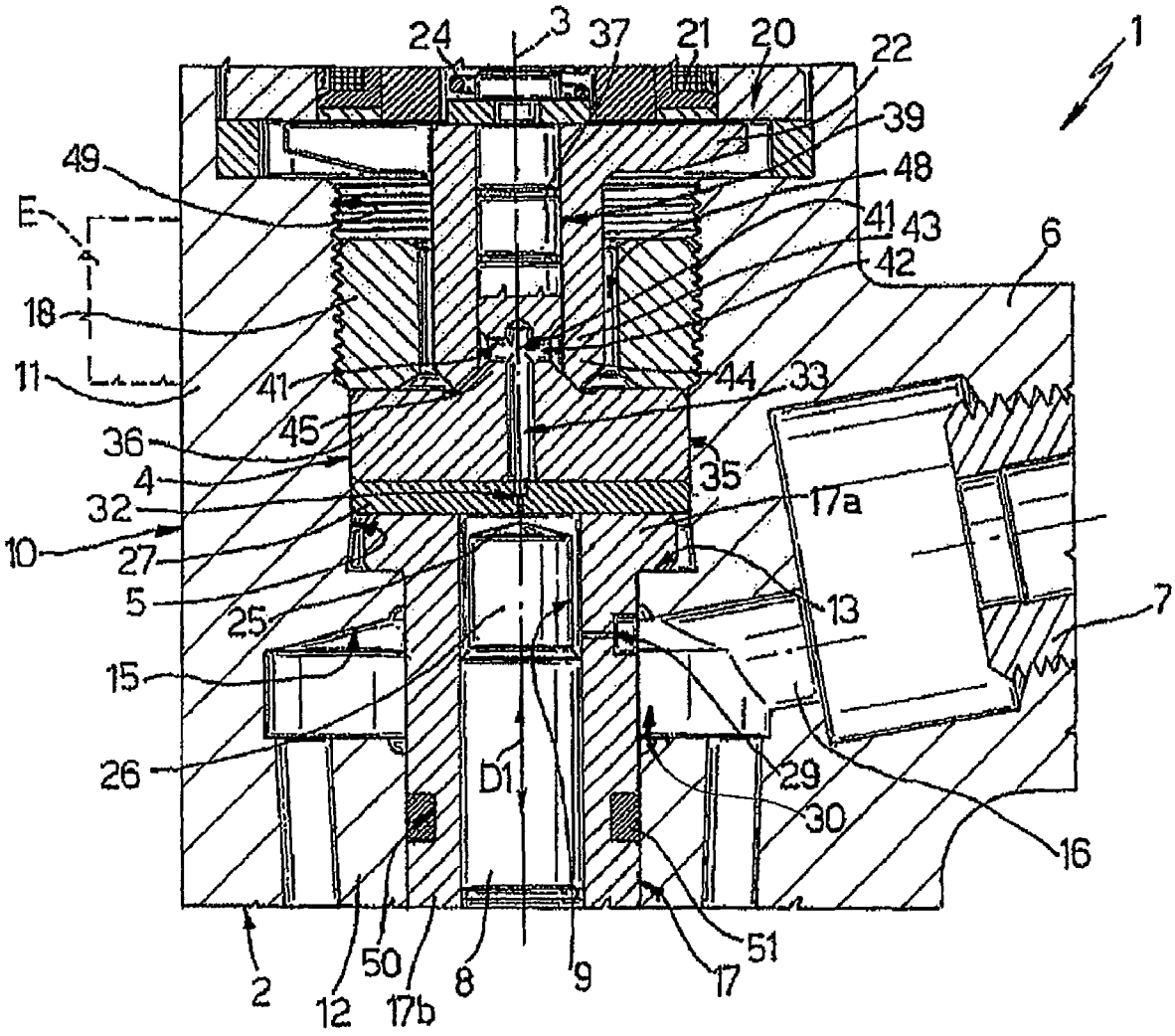
FIG. 1 is a cross-sectional view, with parts removed for reasons of clarity, of a fuel injector made according to the teachings of the present invention.

In FIG. 1, the reference number 1 designates, as a whole, a fuel injector for an internal-combustion engine E illustrated in a schematic way and with a dashed line in FIG. 1.

The injector 1 comprises: a tubular-shaped injector body 2 having an axis 3; a servo-valve 4 housed in a seat 5 of the injector body 2; a connector 6 for connecting the injector 1 to a pipe 7 for supply of fuel at a pressure higher than one thousand bar; and a rod 8, which is set partially in a chamber 9 of the servo-valve 4 and is mobile in a direction D1 parallel to the axis 3.

In the sequel of the present treatment, the reference number 3 designates both the axis of the injector body 2 and the axis of the injector 1, which, in effect, coincide.

The injector body 2 has a substantially cylindrical side wall 10, in which the seat 5 is made. The side wall 10 has two cylindrical axial end stretches, designated by 11 and 12, which extend sharing the same axis 3, and of which the stretch 11 has a diameter greater than the stretch 12. The stretches 11 and 12 are adapted to one another by a radial shoulder 13 orthogonal to the axis 3. Provided on the stretch 12 is a circumferential annular recess 15, which communicates with the supply pipe 7 through a passage 16 made through the stretch 12.

Once again with reference to FIG. 1, the servo-valve 4 comprises a T-shaped valve body 17, and has a head 17*a* of its own fixed to the injector body 2 by means of a ring-nut 18, which pushes the head 17*a* against the shoulder 13 of the injector body 2, providing a fluid-tight coupling. The servo-valve 4 further comprises an actuator device 20 coaxial to the rod 8 and provided with an electromagnet 21. The servo-valve 4 further comprises: an anchor 22, which has a sectored configuration and is axially slidable in the stretch 11 under the action of the electromagnet 21; and a pre-loaded spring 24, which is surrounded by the electromagnet 21 and exerts an action of thrust on the anchor 22 in a direction opposite to the attraction exerted by the electromagnet 21 itself.

According to what is illustrated in detail once again in FIG. 1, the chamber 9 is axially delimited between a terminal surface 25 of the portion 26 of the rod 8 and an end disk 27 housed inside the chamber 5 of the injector body 2 in a fixed position between the actuator device 20 and the head 17*a* of the valve body 17.

The chamber 9 communicates permanently with the pipe 7 for receiving fuel under pressure through a radial calibrated duct 29 made in the valve body 17 and an annular chamber 30. The chamber 30, which is made in a position adjacent to the head 17*a,* is delimited by the recess 15, at one side, and an intermediate cylindrical portion of the valve body 17 itself.

The chamber 9 moreover communicates, via a calibrated duct 32 sharing the axis 3, with a further chamber 33, which also shares the same axis 3 and is made in a distribution body 35 set in an intermediate axial position between the disk 27 itself and the actuator device 20.

The body 35 comprises a base 36 axially packed tight against the disk 27, in a fluid-tight way and in a fixed position, by means of a ring-nut 18 screwed to an internal surface of the stretch 11 and axially coupled so that it bears upon an external annular portion of the base 36. The body 35 further comprises a stem or pin 37, which extends from the base 36 along the axis 3 on opposite sides of the base 36 with respect to the disk 27, is delimited on the outside by a cylindrical surface 39, and is made of a single piece with the base 36.

Once again with reference to FIG. 1, the chamber 33 extends through the base 36 and part of the stem 37, sharing the axis 3, and communicates, on diametrically opposite sides, with respective radial holes 41 made in the stem 37. The holes 41 give out, in an axial position adjacent to the base 36, into an annular chamber 42 dug along the surface 39.

The chamber 42 defines, in a radially external position, an annular gap or port designed to be opened/closed by an open/close element defined by a sleeve 43 actuated by the actuator device 20 for varying the pressure in the control chamber 9 and, hence, controlling axial translation of the rod 8.

The sleeve 43 is made of a single piece with the anchor 22 and has an internal cylindrical surface coupled to the surface 39 substantially in a fluid-tight way so as to slide axially between an advanced end-of-travel position and a retracted end-of-travel position.

In particular, in the advanced end-of-travel position, the sleeve 43 closes the external annular gap of the chamber 42 by being coupled so that it bears, at one 44 of its ends, upon a conical shoulder 45, which connects the surface 39 of the stem 37 to the base 36. In this position, the fuel exerts a zero resultant force of axial thrust on the sleeve 43, since the pressure in the chamber 42 acts radially on the internal cylindrical surface of the sleeve 43 itself.

In the retracted end-of-travel position, the end 44 of the sleeve 43 is set at a distance from the shoulder 45 and delimits therewith a gap for passage of the fuel towards an annular channel 48 delimited by the ring-nut 18 and by the sleeve 43 itself. The annular channel 48 communicates, through the cavity 49 of the injector body 2, with a respective exhaust or recirculation pipe (not illustrated).

Once again with reference to FIG. 1, the valve body 17 comprises, in addition to the head 17*a,* a cylindrical hollow stem 17*b,* with axis 3, which extends inside the stretch 12 of the seat 5, and is provided with an annular groove 50, which is made on an intermediate stretch of the stem 17*b* set underneath, and axially at a distance from, the annular chamber 30. The groove 50 is engaged by an annular seal body 51, which is made of an appropriate plastic material, preferably PTFE with bronze fillers, or of materials known by the commercial names "Turcite" or "Turcon", and projects in cantilever fashion from the outer periphery of the stem 17*b* to co-operate, by bearing thereupon, with an appropriate shoulder fixed to the valve body 17 and by radial coupling with a portion of the stretch 12 adjacent to the annular chamber 30 for providing fluid tightness. Conveniently, the body 51 is directly moulded onto the stem 17*b,* so as to render it integral with the valve body, by deposition of the material forming the body 51 itself directly in the groove 50.

Figure 2:
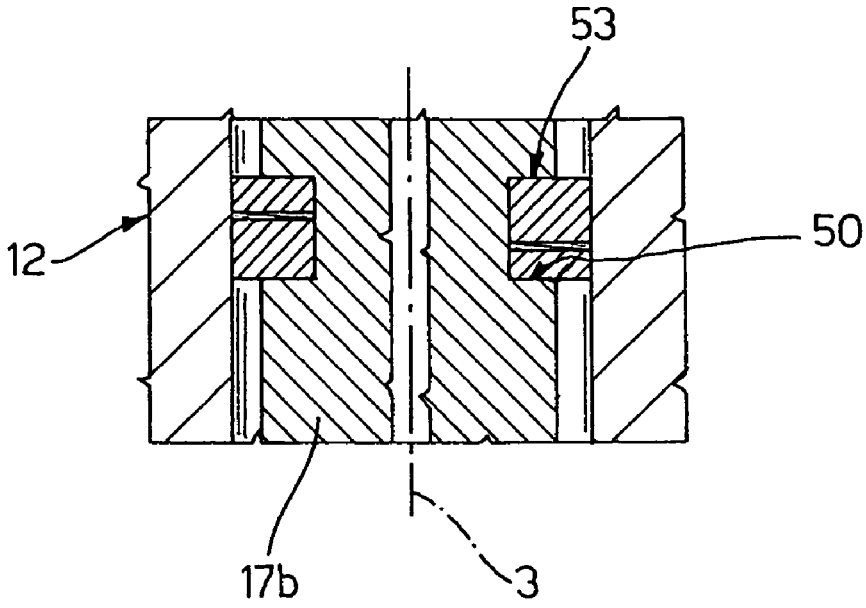
FIG. 2 is a cross-sectional view of a first variant of an item represented in FIG. 1.

Alternatively, according to what is illustrated in FIG. 2, the body 51 is replaced with a helical body 53, having preferably one complete turn and two truncated end turns. The helical body 53 is made separately from the valve body and is subsequently coupled to the valve body by being inserted into the seat 50.

Figure 3:
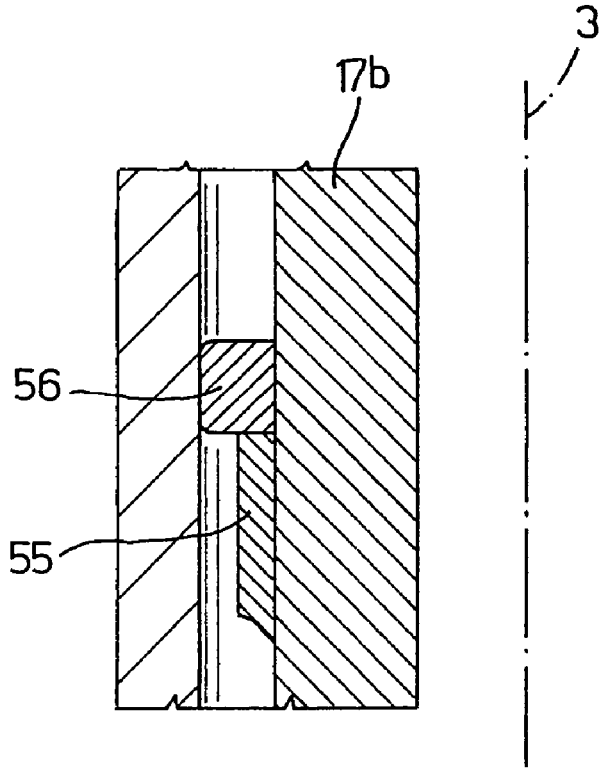
FIG. 3 is a partially sectioned view of a second variant of an item represented in FIG. 2.

In the further variant illustrated in FIG. 3, the stem 17*b* is without external grooves, has a rectilinear generatrix and carries, fitted so that it is axially fixed, an additional supporting body 55, on which there rests an annular body 56, which also extends beyond the outer periphery of the stem 17*b* and of the additional body 55 to provide fluid tightness.

In use, the fuel under pressure introduced into the annular chamber 30 exerts, on the bodies 51, 53 or 56, an axial thrust directed downwards, i.e., towards the nebulizer element (not illustrated). Since said bodies are carried by the valve body, said thrust is unloaded onto the valve body. Said thrust has a direction opposite to the one exerted by the pressure on the valve body itself on account of the seal provided by coupling of the head 17*a* of the valve against the shoulder 13. The valve body is hence subjected to the action of two thrusts acting in opposite directions and of a substantially equal magnitude and is hence substantially balanced. Said balancing prevents displacements and/or elastic local deformations of the valve body itself in the direction of the actuator device 20, ensuring, in this way, a substantial geometrical invariance of the valve body and a constancy of relative positioning of the various parts in relative motion irrespective of the pressure of the fuel.

Moulding of seal bodies directly on the valve body enables the seal body to be blocked in a permanent way on the valve body. The use of helical seal bodies and/or of an additional supporting body enables, instead, the operations of installation of the seal body on the valve body to be simplified and speeded up, guaranteeing, however, at the same time, a stable and correct positioning and an effective seal.

From the foregoing description it appears clearly evident that modifications and variations can be made to the injector 1 described herein, without departing from the sphere of protection defined by the ensuing claims. In particular, the seal bodies carried by the valve body can be made in ways that differ from the ones indicated herein and using materials that are different from the ones described purely by way of example.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A fuel injector for an internal-combustion engine, comprising:

an injector body including a substantially cylindrical side wall having a longitudinal axis and an inner surface forming a first shoulder;

an injection-control valve including a valve body fixedly positioned in said injector body and delimiting an annular chamber configured to receive a fuel under pressure, said valve body forming a fuel chamber configured to communicate fuel in a first direction away from the valve body toward a servo-valve, said valve body having a head, a duct in fluid communication with the annular chamber and the fuel chamber to communicate fuel therebetween, the head sealingly positioned against the first shoulder, introduction of fuel to the annular chamber and through the duct and fuel chamber subjecting the valve body to a first thrust along the first direction;

a support surface formed in, or fixedly attached to, an outer surface of the valve body facing the inner surface of the injector body, the support surface being spaced from the annular chamber in a second direction, opposite the first direction; and a seal member positioned between said inner surface of the injector body and said outer surface of the valve body, said seal member being supported by said support surface against movement in the second direction, said seal member being subjected to a pressure of the fuel reaching the seal member from the annular chamber between the outer surface of the valve body and inner surface of the injector body during operation, the support surface being subjected to a second thrust resulting from the fuel pressure on the seal member, the support surface transferring the second thrust to the valve body in the second direction, preventing one-sided thrust loading of the valve body.

2. The injector according to claim 1, wherein said seal member is a body made of plastic material.

3. The injector according to claim 1, wherein said support surface includes a recess, the seal member being radially coupled to or bearing against said inner surface of said substantially cylindrical sidewall adjacent to said annular chamber.

4. The injector according to claim 1, wherein said support surface includes an outer perimetral seat, and said seal member is partially supported by said perimetral seat.

5. The injector according to claim 4, wherein said perimetral seat is a circumferential seat.

6. The injector according to claim 1, wherein said seal member is integral with said valve body.

7. The injector according to claim 6, wherein said seal member is moulded directly on said valve body by depositing the material in said groove.

8. The injector according to claim 1, wherein said seal member is distinct from said valve body and has a helical shape.

9. The injector according to claim 1, wherein said seal member is coupled to a supporting body distinct from said valve body and stably connected to the valve body.

10. The injector according to claim 9, wherein said supporting body is fitted on said valve body.

11. The injector according to claim 1, wherein said substantially cylindrical side wall includes two cylindrical stretches adapted to each other by said first shoulder.

12. A fuel injector for an internal-combustion engine, comprising:

an injector body having an axis and an inner surface concentric about the axis, the inner surface including a first shoulder;

an injection-control valve including a valve body fixed in the injector body within at least a portion of the inner surface, the valve body having a generally laterally extending head portion and a generally axially extending stem portion, the head portion being forced against the first shoulder, forming a fluid tight coupling therebetween and fixing the valve body in the injector body, the valve body forming a fuel chamber configured to communicate fuel in a first direction away from the stem toward and out of the head, the valve body having a duct in fluid communication with the fuel chamber to introduce fuel thereto;

an annular chamber formed at least in part by the valve body and in fluid communication with the duct, the annular chamber configured to receive fuel and direct the fuel through the duct to the fuel chamber, introduction of fuel to the annual chamber and through the duct and fuel chamber subjecting the valve body to a first thrust along the first direction;

an annular groove formed in the stem portion of the valve body and spaced from the annular chamber in a second direction, opposite the first direction; and a seal positioned in the annular groove between the valve body and the injector body, the annular groove supporting the seal against movement in the second direction, the seal being subjected to a pressure of the fuel reaching the seal member from the annular chamber between the outer surface of the valve body and inner surface of the injector body during operation, the groove being subjected to a second thrust resulting from supporting the seal against the fuel pressure on the seal member, the groove transferring the second thrust to the valve body in the second direction, preventing one-sided thrust loading of the valve body.

13. The fuel injector according to claim 12, further comprising:

a ring-nut threadedly coupled on an outer surface thereof to the inner surface of the injector body, the ring-nut operable to selectively force the head portion of the valve body against the first shoulder of the injector body.

14. The fuel injector according to claim 12 wherein the head portion of the valve body extends substantially laterally with respect to the axis of the injector body and the stem portion of the valve body extends substantially axially, the head and stem portions forming a generally T-shaped structure, the stem portion having an outer surface adjacent a portion of the inner surface of the injector body, the outer portion of the stem having the annular groove and captively receiving the seal member.

* * * * *